US010813416B2

(12) United States Patent
Liu et al.

(10) Patent No.: US 10,813,416 B2
(45) Date of Patent: Oct. 27, 2020

(54) SLIDING-TYPE LOCKING BUCKLE

(71) Applicant: Qingdao GoerTek Technology Co., Ltd., Qingdao, ShanDong Province (CN)

(72) Inventors: Wei Liu, Qingdao (CN); Wenlai Zhang, Qingdao (CN); Yang Yang, Qingdao (CN)

(73) Assignee: QINGDAO GOERTEK TECHNOLOGY CO., LTD., Qingdao (CN)

( * ) Notice: Subject to any disclaimer, the term of this patent is extended or adjusted under 35 U.S.C. 154(b) by 191 days.

(21) Appl. No.: 16/305,770

(22) PCT Filed: Dec. 31, 2016

(86) PCT No.: PCT/CN2016/114037
§ 371 (c)(1),
(2) Date: Nov. 29, 2018

(87) PCT Pub. No.: WO2018/036074
PCT Pub. Date: Mar. 1, 2018

(65) Prior Publication Data

US 2019/0343242 A1 Nov. 14, 2019

(30) Foreign Application Priority Data

Aug. 25, 2016 (CN) ..... 2016 1 0719590

(51) Int. Cl.
*A41F 1/00* (2006.01)
*A44B 11/25* (2006.01)
*A44B 19/30* (2006.01)

(52) U.S. Cl.
CPC ..... *A44B 11/2592* (2013.01); *A44B 19/303* (2013.01)

(58) Field of Classification Search
CPC ..... A44B 11/2592; A44B 19/303
See application file for complete search history.

(56) References Cited

U.S. PATENT DOCUMENTS 350,846 A * 10/1886 Sanders ..... A41F 5/00 24/686
1,507,216 A * 9/1924 Stockton ..... A41F 1/00 24/595.1

(Continued)

FOREIGN PATENT DOCUMENTS

CN 1101819 A 4/1995
CN 2720770 Y 8/2005

(Continued)

OTHER PUBLICATIONS

May 24, 2017 International Search Report issued in International Patent Application No. PCT/CN2016/114037.

(Continued)

*Primary Examiner* — Jason W San
(74) *Attorney, Agent, or Firm* — Arent Fox LLP

(57) ABSTRACT

A sliding-type locking buckle comprises a casing and a locking buckle body. The casing comprises an upper casing, a lower casing, and an inner cavity. The locking buckle body comprises an upper body, a lower body, and a compression spring. The upper casing is provided with an upper sliding slot. The inner wall of the upper casing is provided with a plurality of sawteeth along the length direction of the upper sliding slot. The lower body is located in the inner cavity. The top of the upper body protrudes out of the upper sliding slot. A lateral surface of the upper body is provided with a limiting protrusion. The limiting protrusion is provided with a sawtooth portion.

9 Claims, 3 Drawing Sheets

(56) References Cited

U.S. PATENT DOCUMENTS

| | | | | | |
|---|---|---|---|---|---|
| 1,957,257 | A * | 5/1934 | Freysinger | A41F 1/008 | 24/593.11 |
| 4,062,063 | A * | 12/1977 | Bloom | A42B 1/205 | 2/184.5 |
| 5,404,623 | A * | 4/1995 | Smiedt | A41F 1/008 | 24/194 |
| 5,404,823 | A | 4/1995 | Smiedt | | |
| 5,491,845 | A * | 2/1996 | Takimoto | A41F 9/002 | 2/338 |
| 5,774,952 | A * | 7/1998 | Ito | A41F 1/008 | 24/578.15 |
| 5,774,953 | A * | 7/1998 | Mao | A44B 11/2592 | 24/170 |
| 9,241,543 | B1 * | 1/2016 | Peng | A44B 11/12 | |
| 9,421,145 | B2 * | 8/2016 | Heller | A61H 39/04 | |
| 9,770,073 | B2 * | 9/2017 | Ryou | A44B 11/16 | |
| 10,159,291 | B1 * | 12/2018 | Ortega | A44B 11/266 | |
| 2015/0067989 | A1 * | 3/2015 | Hortnagl | A44B 11/02 | 24/197 |

FOREIGN PATENT DOCUMENTS

| | | | |
|---|---|---|---|
| CN | 204218061 | U | 3/2015 |
| CN | 106165945 | A | 11/2016 |
| CN | 205923149 | U | 2/2017 |
| WO | WO 9701319 | A1 | 1/1997 |

OTHER PUBLICATIONS

May 24, 2017 Written Opinion issued in International Patent Application No. PCT/CN2016/114037.

* cited by examiner

SLIDING-TYPE LOCKING BUCKLE

CROSS REFERENCE TO RELATED APPLICATIONS

This application is a U.S. National Stage entry under 35 U.S.C. § 371 based on International Application No. PCT/CN2016/114037, filed on Dec. 31, 2016, which was published under PCT Article 21(2) and which claims priority to Chinese Patent Application No. 201610719590.2, filed on Aug. 25, 2016. The embodiment of the priority applications are hereby incorporated herein in their entirety by reference.

TECHNICAL FIELD

The present disclosure relates to a locking buckle structure, and in particular to a sliding-type locking buckle which can slide in any traveling range and can be positioned at any position within the traveling range.

BACKGROUND

Many items in daily life comprise two parts that are connected by a locking buckle, for example, an elastic ring-shaped band such as a headband of a headgear, and a strap of an article. In the prior art, the locking buckles used in such items generally comprises a common plastic locking buckle and a plastic locking buckle with a sliding switch.

Specifically, as shown in FIG. 1, the structure of the common plastic locking buckle comprises a fixed casing 1, a locking buckle body 2 and a resilient arm 3, and it has the disadvantages that the position of the locking buckle body is fixed, it cannot slide, and it can be used only in limited situations. As shown in FIG. 2, the structure of the plastic locking buckle with a sliding switch comprises a plastic casing 1 and a sliding switch 2. Although the locking buckle can slide within a certain traveling range, the sliding range is limited, and the sliding function must be realized through the sliding switch 2. Therefore, the cost is high, its use is limited, and it can stop at only 2 or 3 stop positions rather than any position within the traveling range.

SUMMARY

A sliding-type locking buckle, comprising a casing and a locking buckle body mounted on the casing, wherein the casing comprises an upper casing, a lower casing and an inner cavity enclosed by the upper casing and the lower casing, and the upper casing and the lower casing are fixedly connected together;

the locking buckle body comprises an upper body, a lower body and a compression spring located between the upper body and the lower body;

the upper casing is provided with an upper sliding slot penetrating the upper casing in its thickness direction, and a plurality of sawteeth are disposed on an inner wall of the upper casing along a length direction of the upper sliding slot;

the lower body is located in the inner cavity, and a top of the upper body protrudes out of the upper sliding slot;

a lateral surface of the upper body is provided with a limiting protrusion which is disposed in the inner cavity of the casing, and the limiting protrusion is provided with a sawtooth portion matching the sawteeth on the inner wall of the upper casing.

Optionally, the sawteeth are provided at both lateral sides of the upper sliding slot in the length direction.

Optionally, a mounting post is fixed on a lower surface of the upper body, a mounting hole is provided on the lower body, a bottom end of the mounting post is inserted into the mounting hole, and the compression spring is sleeved on the mounting post.

Optionally, a sliding guide post is fixed on the lower surface of the lower body, the lower casing is provided with a lower sliding slot, the length direction of the lower sliding slot is parallel to the length direction of the upper sliding slot, and the sliding guide post is embedded in the lower sliding slot.

Optionally, the lower body is provided with a guide groove, and a lower portion of the upper body is embedded in the guide groove.

Optionally, the upper casing and the lower casing are integrally fixed by screws.

DETAILED DESCRIPTION

The technical solutions of the present disclosure are further described in detail below with reference to the accompanying drawings and specific embodiments.

Compared with the prior art, the sliding-type locking buckle according to the present disclosure can achieve the sliding in any traveling range by pressing the locking buckle body and making the locking buckle body slide along the length direction of the upper sliding slot. When the locking buckle body needs stopping, one may just release the locking buckle body, so that the sawtooth portion on the upper body are engaged with the sawteeth on the upper casing, thereby stopping the locking buckle body at any position within the traveling range. Moreover, by changing the tooth width of the sawteeth, different adjustable sliding ranges can be achieved.

Figure 1:
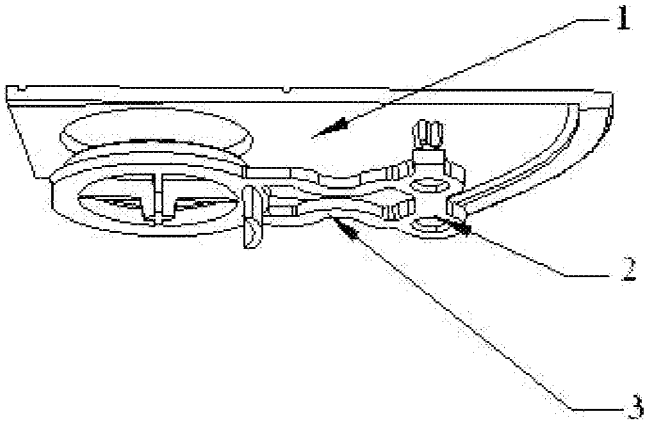
FIG. 1 is a structural view of a common plastic locking buckle in the prior art.
Figure 2:
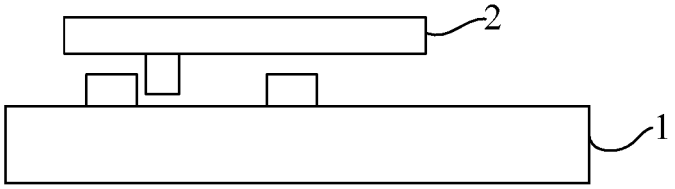
FIG. 2 is a structural view of a plastic locking buckle with a sliding switch in the prior art.
Figure 3:
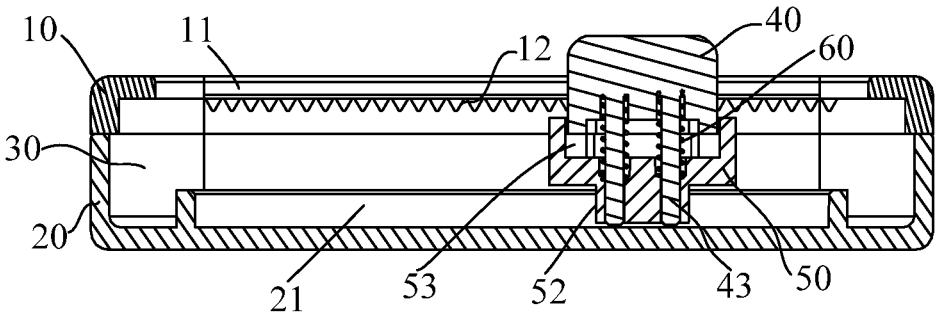
FIG. 3 is a longitudinal sectional view of a sliding-type locking buckle according to the present disclosure in which the cutting plane passes through the center of the entire structure.
Figure 4:
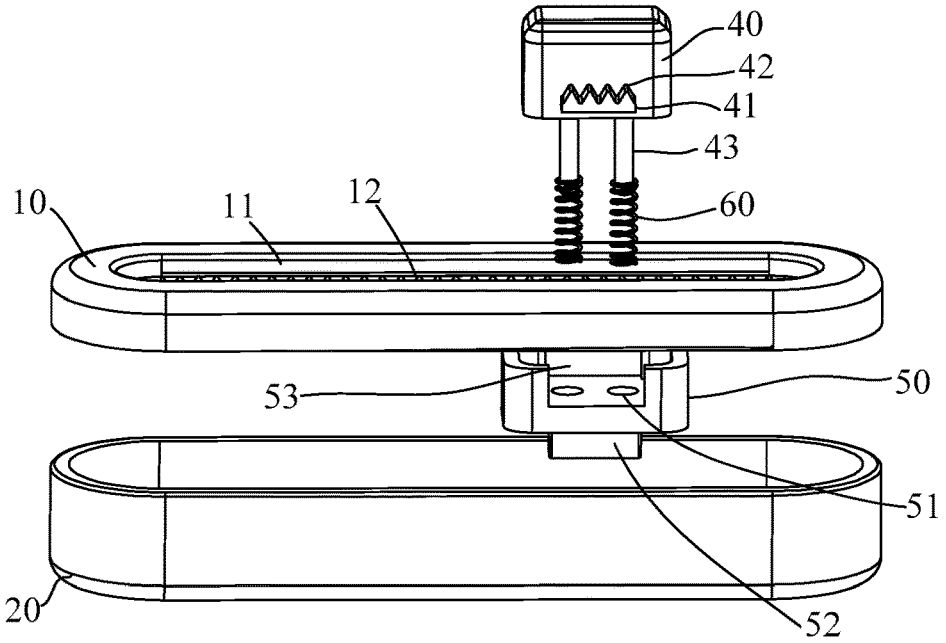
FIG. 4 is an exploded structural view of a sliding-type locking buckle according to the present disclosure.
Figure 5:
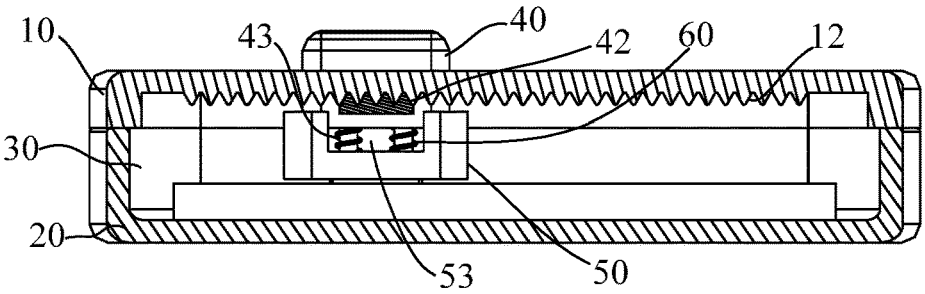
FIG. 5 is a longitudinal sectional view of a sliding-type locking buckle according to the present disclosure in which the cutting plane passes through the sawteeth on the locking buckle body.

Referring to FIG. 3 to FIG. 5, a sliding-type locking buckle of the present embodiment comprises a casing and a locking buckle body mounted on the casing. The casing comprises an upper casing 10, a lower casing 20 and an inner cavity 30 enclosed by the upper casing 10 and the lower casing 20, and the upper casing 10 and the lower casing 20 are fixedly connected together. The locking buckle body comprises an upper body 40, a lower body 50, and a compression spring 60 located between the upper body 40 and the lower body 50. The upper casing 10 is provided with an upper sliding slot 11 penetrating the upper casing 10 in its thickness direction, and a plurality of sawteeth 12 are disposed on an inner wall of the upper casing 10 along the length direction of the upper sliding slot 11. The lower body 50 is located in the inner cavity 30 of the casing, and the top of the upper body 40 protrudes out of the upper sliding slot 11 to facilitate touch operation by hand. A lateral surface of the upper body 40 is provided with a limiting protrusion 41 which is disposed in the inner cavity 30 of the casing, and the limiting protrusion 41 is provided with a sawtooth portion 42 matching the sawteeth 12 on the inner wall of the upper casing 10.

The locking buckle body is placed in the inner cavity 30 of the casing through the upper sliding slot 11, and is restrained in the upward direction by the limiting protrusion 41 on the lateral surface thereof to prevent it from coming out of the inner cavity 30. The compression spring 60 is disposed between the upper body 40 and the lower body 50 of the locking buckle body, so that the upper body 40 can be pressed, and when no external force is applied, the limiting protrusion 41 of the upper body 40 abuts against the inner wall of the upper casing 10 under the elastic force of the compression spring 60, and the sawtooth portion 42 on the limiting protrusion 41 engages with the sawteeth 12 on the inner wall of the upper casing 10. At the same time, the lower body 50 abuts against the inner wall the lower casing 20 under the elastic force of the compression spring 60, thereby achieving the stopping and positioning of the locking buckle body.

When the locking buckle body needs sliding, one may just press the upper body 40 downwardly to disengage the sawtooth portion 42 from the sawteeth 12 on the inner wall of the upper casing 10, and move the upper body 40 along the length direction of the upper sliding slot 11, and drive the lower body 50 and the compression spring 60 to slide together, thereby achieving the sliding in any traveling range within the length of the upper sliding slot 11.

When the locking buckle body needs stopping, one may just release the upper body 40, so that the sawtooth portion 42 on the upper body engages with the sawteeth 12 on the upper casing 10, as shown in FIG. 3, thereby stopping the locking buckle body at any position within the traveling range.

The fixed connection of the upper casing 10 and the lower casing 20 may be achieved by screws or gluing, etc.

Figure 6:
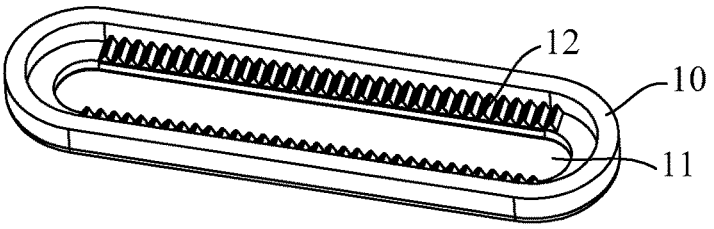
FIG. 6 is a schematic structural view of an upper casing of a sliding-type locking buckle according to the present disclosure.
Figure 7:
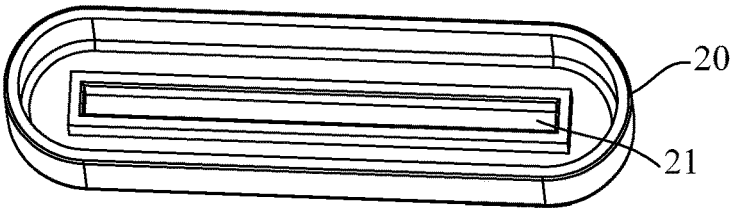
FIG. 7 is a schematic structural view of a lower casing of a sliding-type locking buckle according to the present disclosure.

Referring to FIG. 6, in order to be positioned smoothly when the locking buckle body stops, the sawteeth 12 are provided on both of the lateral sides of the upper sliding slot 11 in its length direction. Correspondingly, the limiting protrusions 41 are provided on a set of lateral surfaces of the upper body 40, and each of the limiting protrusions 41 is provided with a sawtooth portion 42 correspondingly.

Figure 8:
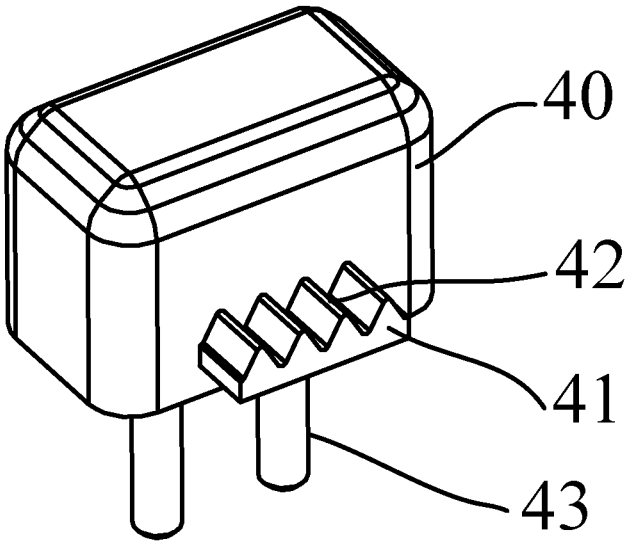
FIG. 8 is a schematic structural view of an upper body of a sliding-type locking buckle according to the present disclosure.

Further, as shown in FIG. 3 to FIG. 5 in combination with FIG. 8, a mounting post 43 is fixed on the lower surface of the upper body 40, and a mounting hole 51 is provided on the lower body 50. The bottom end of the mounting post 43 is inserted into the mounting hole 51. The compression spring 60 is sleeved on the mounting post 43. The mounting post 43 can guide and limit the compression spring 60, and at the same time, it can connect the upper body 40 and the lower body 50, so that when the upper body 40 is slid or moved, the lower body 50 can smoothly slide together with the upper body 40. In order to make the compression spring 60 move up and down smoothly, the number of the mounting post 43 is preferably two. Correspondingly, the number of the compression springs 60 is two, and the number of the mounting holes 51 is two.

Figure 9:
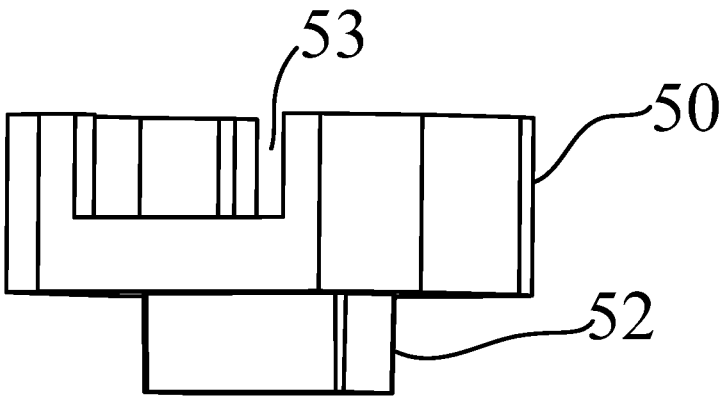
FIG. 9 is a schematic structural view of a lower body of a sliding-type locking buckle according to the present disclosure.

In order to further make the locking buckle body slide smoothly and reduce the friction, as shown in FIG. 3 and FIG. 5 in combination with FIG. 9, a sliding guide post 52 is fixed on the lower surface of the lower body 50, and the lower casing 20 is provided with a lower sliding slot 21. The length direction of the lower sliding slot 21 is parallel to the length direction of the upper sliding slot 11. The sliding guide post 52 is embedded in the lower sliding slot 21. In this way, the friction in sliding between the lower body 50 and the lower casing 20 can be reduced, and at the same time, the sliding of the lower body 50 can be guided, so that the sliding of the entire locking buckle body is smooth.

Similarly, in order to guide the up and down movement of the upper body 40 of the locking buckle body, as shown in FIG. 3 and FIG. 5 in combination with FIG. 9, the lower body 50 is provided with a guide groove 53, and a lower portion of the upper body 40 is embedded in the guide groove 53.

The above embodiments are only intended to illustrate the technical solutions of the present disclosure, and are not to limit the present disclosure. Although the present disclosure is described in detail with reference to the above embodiments, a person skilled in the art may still modify the technical solutions set forth in the above embodiments, or equivalently substitute part of the technical features of them. However, those modifications or substitutions do not make the essence of the corresponding technical solutions depart from the spirit and scope of the claimed technical solutions of the present disclosure.

What is claimed is:

1. A sliding-type locking buckle, comprising a casing and a locking buckle body mounted on the casing, wherein the casing comprises an upper casing, a lower casing and an inner cavity enclosed by the upper casing and the lower casing, and the upper casing and the lower casing are fixedly connected together;

the locking buckle body comprises an upper body, a lower body and a compression spring located between the upper body and the lower body;

the upper casing is provided with an upper sliding slot penetrating the upper casing in its thickness direction, and a plurality of sawteeth are disposed on an inner wall of the upper casing along a length direction of the upper sliding slot;

the lower body is located in the inner cavity, and a top of the upper body protrudes out of the upper sliding slot;

a lateral surface of the upper body is provided with a limiting protrusion which is disposed in the inner cavity of the casing, and the limiting protrusion is provided with a sawtooth portion matching the sawteeth on the inner wall of the upper casing.

2. The sliding-type locking buckle according to claim 1, wherein the sawteeth are provided at both lateral sides of the upper sliding slot in the length direction.

3. The sliding-type locking buckle according to claim 1, wherein a mounting post is fixed on a lower surface of the upper body, a mounting hole is provided on the lower body, a bottom end of the mounting post is inserted into the mounting hole, and the compression spring is sleeved on the mounting post.

4. The sliding-type locking buckle according to claim 1, wherein a sliding guide post is fixed on the lower surface of the lower body, the lower casing is provided with a lower sliding slot, the length direction of the lower sliding slot is parallel to the length direction of the upper sliding slot, and the sliding guide post is embedded in the lower sliding slot.

5. The sliding-type locking buckle according to claim 1, wherein the lower body is provided with a guide groove, and a lower portion of the upper body is embedded in the guide groove.

6. The sliding-type locking buckle according to claim 1, wherein the upper casing and the lower casing are integrally fixed by screws.

7. The sliding-type locking buckle according to claim 2, wherein the lower body is provided with a guide groove, and a lower portion of the upper body is embedded in the guide groove.

8. The sliding-type locking buckle according to claim 3, wherein the lower body is provided with a guide groove, and a lower portion of the upper body is embedded in the guide groove.

9. The sliding-type locking buckle according to claim 4, wherein the lower body is provided with a guide groove, and a lower portion of the upper body is embedded in the guide groove.

* * * * *